US006899522B2

(12) United States Patent
Baur et al.

(10) Patent No.: US 6,899,522 B2
(45) Date of Patent: May 31, 2005

(54) METHOD FOR MANUFACTURING A TURBINE WHEEL ROTOR

(75) Inventors: Hartmut Baur, Ertingen (DE); Peter Busse, Aachen (DE); Peter Fledersbacher, Stuttgart (DE); Daniel Bala Wortberg, Ulm (DE)

(73) Assignee: DaimlerChrysler AG, Stuttgart (DE)

( * ) Notice: Subject to any disclaimer, the term of this patent is extended or adjusted under 35 U.S.C. 154(b) by 16 days.

(21) Appl. No.: 10/377,475

(22) Filed: Feb. 28, 2003

(65) Prior Publication Data

US 2004/0009072 A1 Jan. 15, 2004

(30) Foreign Application Priority Data

Mar. 2, 2002 (DE) ..... 102 09 347

(51) Int. Cl.[7] ..... B63H 1/28

(52) U.S. Cl. ..... 415/216.1; 415/200; 416/244 R; 416/244 A; 29/889.21

(58) Field of Search ..... 415/216.1, 200; 416/244 R, 244 A, 244 B; 29/889, 889.21

(56) References Cited

U.S. PATENT DOCUMENTS

| | | | | |
|---|---|---|---|---|
| 1,549,218 A | | 8/1925 | Rayn | 164/106 |
| 4,240,495 A | * | 12/1980 | Vonnegut | 164/125 |
| 5,193,607 A | * | 3/1993 | Demukai et al. | 164/493 |
| 5,365,661 A | * | 11/1994 | Mizuno et al. | 29/889.21 |
| 6,007,301 A | * | 12/1999 | Noda et al. | 416/213 R |
| 6,327,934 B1 | * | 12/2001 | Barthel | 74/607 |
| 6,499,958 B2 | * | 12/2002 | Haugen et al. | 416/204 A |

FOREIGN PATENT DOCUMENTS

| | | |
|---|---|---|
| CH | 425101 | 5/1967 |
| DE | 400746 | 8/1924 |
| DE | 2033369 | 1/1972 |
| DE | 3044992 | 6/1982 |
| DE | 692180 B2 | 3/1993 |
| DE | 3943683 | 7/1994 |
| DE | 4304481 | 8/1994 |
| DE | 195112 B2 | 10/1996 |
| DE | 19745725 | 1/1999 |
| DE | 29724028 | 9/1999 |
| DE | 19748874 | 3/2000 |
| EP | 0368642 | 5/1990 |
| EP | 0532434 | 3/1997 |
| GB | 104774 | 11/1966 |
| JP | 2173322 | 7/1990 |

OTHER PUBLICATIONS

Lutz "Druckguss—ein wirtschaftliches Fertigungsverfahren," in TZ fuer prakt. Metallarbeit, vol. 10, 1961, pp. 576 (translation enclosed).

STETS "Werkstoffkundliche Grundlagen des Verbundgiessens von Gusseisen mit Stahl." in Giesserei 86, Aug. 19, 1999, pp. 55 (translation enclosed).

Aluminium Taschenbuch "7.7. Sondergiessverfahren" 13$^{th}$ Ed. 1974 (see translation).

* cited by examiner

*Primary Examiner*—Hoang Nguyen
(74) *Attorney, Agent, or Firm*—Davidson, Davidson & Kappel, LLC

(57) ABSTRACT

A method for connecting a wheel, such as a turbine wheel or compressor wheel, in a turbine wheel rotor. The method includes providing a shaft made of steel, and pouring a casting alloy around an end of the shaft, wherein the casting alloy includes an intermetallic compound of the system TiAl. The method is particularly well-suited making a connection of the turbine wheel and the shaft of an exhaust-gas turbocharger for motor vehicles using a casting process. In addition, a turbine wheel rotor, that includes a steel shaft, a cast wheel including a casting alloy fixedly connected to an end of the shaft. The casting alloy including an intermetallic compound of the system TiAl. A connection between the cast wheel and the shaft includes at least one of a friction fit, a positive fit, and an integral connection.

6 Claims, 1 Drawing Sheet

METHOD FOR MANUFACTURING A TURBINE WHEEL ROTOR

This application claims priority to German Patent Application 102 09 347.4-24, filed Mar. 3, 2002, which is incorporated by reference herein.

BACKGROUND

The present invention relates to a method for connecting a wheel, such as a turbine wheel or a compressor wheel to a shaft of a turbine wheel rotor, particularly the turbine wheel of an exhaust-gas turbocharger for motor vehicles. The present invention also relates to a turbine wheel rotor, that includes a steel shaft and a cast wheel including a casting alloy fixedly connected to an end of the shaft.

Currently used turbine wheels are mostly based on Ni-based alloys. In isolated cases, turbine wheels made of TiAl have also been tested and used. According to the prior art, turbine wheels are first manufactured by precision casting or comparable methods and subsequently connected to the shaft in one or more operations. This is usually done by brazing or welding processes. Unlike the turbine wheel, the shaft is conventionally manufactured from steel. The connection must withstand very high mechanical loads, especially during acceleration processes.

At present, single-part bearing housings are used, the shaft being guided therethrough with the fixedly connected turbine wheel and, on the other side, being connected to the compressor wheel by means of a press-fit or screw connection.

The compressor wheels are preferably manufactured from aluminum alloys. This is usually done by precision casting. However, insufficient strength has resulted in that compressor wheels are sometimes also milled from the solid, which is much more cost-intensive. Currently, new approaches attempt to deal with the strength problems of compressor wheels by using titanium alloys.

In mass production, the conventionally used nickel-based turbine wheels are connected to the shaft using friction welding techniques. In the joining technique steel shaft TiAl wheel, usually methods are used in which the shaft is connected via an intermediate piece composed of austenitic stainless steel, of a heat-resistant steel, or of a superalloy based on Ni, Co, or Fe.

Intermediated pieces made of two interconnected cylinder sections are used as well. To connect the intermediate pieces to the shaft and to the wheel, both friction welding techniques and brazing methods are used.

A method for making an interconnection between a turbine rotor made of an intermetallic Ti—Al alloy and a steel component is known from European Patent Publication EP 0368642. The interconnection is accomplished by friction welding using an intermediate piece which is composed, for example, of an austenitic steel. In one embodiment, the intermediate piece was already connected to the Ti—Al alloy part by insert casting.

Japanese Patent Publication JP 02173322 describes an integrally formed Ti—Al turbine rotor composed of a wheel and a shaft.

Apart from single-part models, multi-part turbine rotors have the disadvantage of having to ensure a suitable connection of the individual parts.

SUMMARY OF THE INVENTION

An object of the present invention is to connect the parts of multi-piece turbine wheel rotors in a simple and reliable manner.

The present invention provides method for making an interconnection between a shaft (1) and a turbine wheel (2) of a turbine wheel rotor or a compressor wheel, wherein the interconnection between these parts is made by pouring a casting alloy around a shaft end, the shaft (1) being made of steel and the casting alloy being composed of an intermetallic compound of the system TiAl.

The present invention describes a method for making an in-situ connection of the turbine wheel and the shaft of an exhaust-gas turbocharger for motor vehicles using a casting process.

In the method according to the present invention for making an interconnection between a shaft and a turbine wheel of a turbine wheel rotor or a compressor wheel, the interconnection between these parts is made by pouring a casting alloy around a shaft end.

The connection of the turbine wheel and the shaft is accomplished in that, during the manufacture of the turbine wheel using a precision casting process, the shaft is already integrated in the ceramic shell mold, and thus directly cast-in. If, in the future, two-part bearing housings are used, then it is possible for the shaft not only to be integrally cast into the turbine wheel, but at the same time also into the compressor wheel in one casting operation.

It is decisive for a proper connection that no hot cracks occur during casting. These hot cracks result from tensions due to the volume contraction during the solidification in the solid-liquid interval which exceed the strength of the solidifying material and which cannot heal due to lack of secondary feeding.

According to the present invention therefore, two measures are proposed to prevent these hot cracks. According to the present invention, first of all, the temperature control of the shell mold and of the shaft located therein may be implemented such that a controlled solidification in a direction opposite to the mold filling direction is carried out, preferably including appropriate secondary feeding.

According to the present invention, moreover, a secondary feeding of casting alloy may be carried out at high filling pressure to heal formed cracks.

The casting pressure required to fill the mold is reached due to the centrifugal forces occurring during centrifugal casting. It is particularly advantageous to use one or more separate ceramic shell molds in place of a common casting cluster.

Technically, the process provides the particular advantage of achieving a very rigid connection of the turbine wheel and the shaft due to the press-fit connection. Moreover, it is also possible to achieve optimum positive fit and, possibly even an integral connection.

The manufacturing process advantageously stands out compared to other joining techniques because of its economic efficiency, since the manufacture of the turbine wheel and the connection to the shaft is carried out in one step. This eliminates the need for subsequent processing steps to connect these two components. The same advantages arise on the side of the compressor wheel.

In the method according to the present invention, the connection between the turbine wheel and the shaft is accomplished by pouring the casting alloy around the shaft end.

The connection of a shaft to a turbine wheel of a turbine wheel rotor or to a compressor wheel is primarily a friction fit due to the functional forces between the shaft and the turbine wheel resulting from the press-fit connection.

The fundamental basis of the press-fit connection is provided by the shrinking of the casting alloy on the shaft. Upon solidification, the casting alloy has a considerably higher temperature than the shaft. The volume contraction associated with the cooling of the casting alloy is therefore greater, independently of whether the shaft has a smaller or larger coefficient of thermal expansion than the casting alloy. The turbine wheel made of the casting alloy shrinks on the shaft during cooling.

A further subject matter of the present invention is the configuration of the shaft end in order to accomplish a positive fit. For example, the shaft end can be designed with a circumferential groove so as to produce an undercut around which flows the casting alloy, resulting in a kind of an interlocking of the turbine wheel and the shaft. Moreover, the shaft end should, if possible, be designed such that the shaft and the wheel disk are prevented from rotating relative to each other during later operation. This can be achieved, for example, by a groove or notch, which extends perpendicular to the shaft axis on the shaft end, the groove or notch breaking the rotational symmetry of the shaft and being infiltrated during the filling of the mold. Furrows or notches parallel to the shaft axis are conceivable as well.

The metallurgical joint or integral connection, that is, the fusion or joining by fusion of the turbine wheel and the shaft material, can be achieved by a suitable material combination and selective temperature control of the shaft and of the shell mold. In this context, moreover, any form of groove or notch increases the contact area between the shaft and the casting material, and represents an additional bonding surface in the combination with metallurgical joint.

However, if the intention is to deliberately avoid such a metallurgical joint, then a diffusion barrier can be applied between the casting material and the shaft, at least at the shaft end which is cast-in. Such a diffusion barrier can be composed of a molybdenum film or of a molybdenum layer, which is applied to the shaft and prevents joining by fusion during the mold-filling period.

The shaft of the turbine wheel rotor is preferably composed of steel, of titanium or titanium alloys, or of an intermetallic alloy of the systems titanium-aluminum, in particular based on gamma-TiAl; iron-aluminum, for example, based on FeAl; and of the system nickel-aluminum, for example, based on NiAl.

The turbine wheel and the shaft can be made of the same material. However, it is preferred to use a material for the turbine wheel that has a lower density than shaft material. The materials or intermetallic alloys proposed are those of the systems titanium-aluminum, in particular based on gamma-TiAl; iron-aluminum, for example, based on FeAl; and of the system nickel-aluminum, for example, based on NiAl. According to the present invention, it is also possible to use conventionally employed Ni-based alloys.

DESCRIPTION OF THE DRAWINGS

In the following, the present invention will be described and illustrated in greater detail with reference to several selected exemplary embodiments in connection with the accompanying drawings, in which.

DETAILED DESCRIPTION

Figure 1:
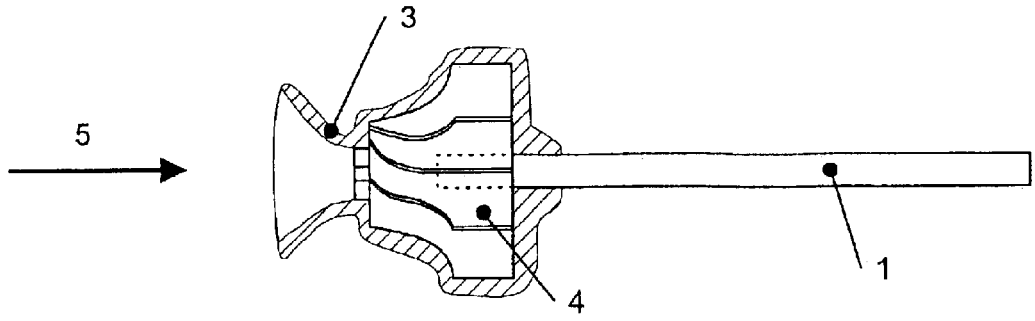
FIG. 1 shows a cross-section of a ceramic shell mold, including an integrated shaft.

The ceramic shell mold with sprue 3, which is shown in FIG. 1, is used as a negative mold with integrated shaft 1 to manufacture the turbine wheel rotor by precision casting. For this purpose, initially, a wax model of the wheel is made using wax injection processes. Subsequently, the ceramic shell mold is built up in several dipping cycles in slurry baths and corresponding sanding operations. The wax is melted out and the shell mold is fired. The present invention proposes to insert the shaft into the mold for injection-molding the wax models and, in this manner, to injection-mold the wax model around the shaft. Also carried out are the conventional dipping and sanding operations, in which, however, not only the wax model, but also a part of or the whole shaft is surrounded by a ceramic shell mold. After melting out the wax, the shaft extends into turbine wheel cavity 4 for the turbine wheel.

The temperature control of shell mold 3 and of shaft 1 located therein is to be implemented such that a controlled solidification in a direction opposite to mold filling direction 5 is carried out, including appropriate secondary feeding.

Figure 2:
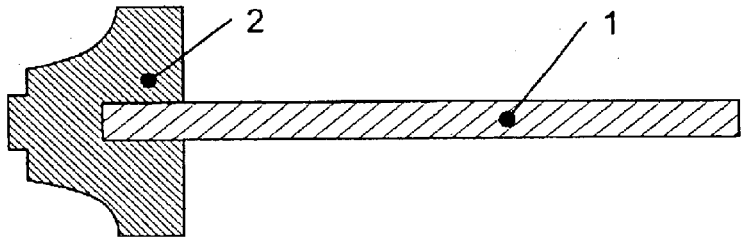
FIG. 2 shows a section through a turbine wheel rotor composed of a shaft and a turbine wheel surrounding the shaft.

FIG. 2 shows the completed turbine wheel rotor composed of shaft 1 and of turbine wheel 2, which surrounds the shaft. The connection between the turbine wheel and the shaft is primarily the press-fit connection shown. In addition, it is possible to accomplish a positive fit. Depending on the selected alloy, in particular in the case of identical or similar shaft and wheel materials, the connection can additionally be of a chemical or metallurgical nature, that is, represent an integral connection.

Figure 3:
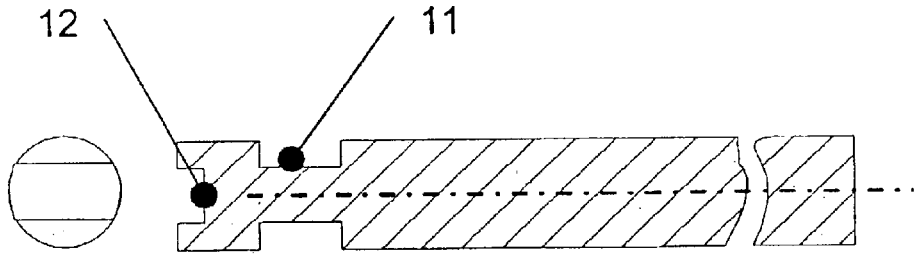
FIG. 3 shows the configuration of the shaft end, which is surrounded by the turbine wheel.

In the view of FIG. 3 is shown, in particular, the configuration of the shaft end. For example, the shaft end can be designed with a circumferential groove 11 so as to produce an undercut around which flows the casting alloy, resulting in a kind of an interlocking of the turbine wheel and the shaft, thus providing a positive fit. Moreover, the shaft end should, if possible, be designed such that the shaft and the wheel disk are prevented from rotating relative to each other during later operation. This can be achieved, for example, by groove or notch 12 shown in the drawing, which extends perpendicular to the shaft axis on the shaft end, the groove or notch breaking the rotational symmetry of the shaft and being infiltrated during the filling of the mold. Furrows or notches parallel to the shaft axis are conceivable as well.

In the future, it might be possible to achieve multi-part bearing housings (as well as turbine and compressor housings); then it is possible for the shaft not only to be integrally cast into the turbine wheel, but at the same time also into the compressor wheel in one casting operation. The fact that, in this case, the compressor wheel cannot be cast from a conventionally used aluminum alloy, but has to be cast from the same, possibly a little more expensive alloy as the turbine wheel can partly be compensated for by the cost savings in the joining technique. Using the higher-strength turbine wheel alloy for the compressor wheel, the current strength problems of aluminum compressor wheels can at the same time be dealt with in a cost-effective manner as well.

What is claimed is:

1. A method for connecting a wheel in a turbine wheel rotor, the method comprising:

providing a shaft made of steel;

pouring a casting alloy around an end of the shaft, wherein the casting alloy includes an intermetallic compound of the system TiAl; and carrying out a solidification of the casting alloy in a direction opposite a mold filling direction.

2. The method as recited in claim 1, wherein the wheel is one of a turbine wheel and a compressor wheel.

3. The method as recited in claim 1, wherein the intermetallic compound is based on gamma-TiAl.

4. The method as recited in claim 1, further comprising assisting a secondary feeding of the casting alloy with high filling pressure during the pouring.

5. The method as recited in claim 1, wherein the solidification is carried out by implementing a temperature control including an appropriate secondary feeding.

6. A method for connecting a wheel in a turbine wheel rotor, the method comprising:

providing a shaft made of steel;

pouring a casting alloy including an intermetallic compound of the system TiAl around an end of the shaft so that the casting alloy directly contacts the steel shaft; and carrying out a solidification of the casting alloy so that the casting alloy fuses with the steel shaft.

* * * * *